US010686249B2

(12) United States Patent
Hamabe

(10) Patent No.: US 10,686,249 B2
(45) Date of Patent: Jun. 16, 2020

(54) ANTENNA DEVICE

(71) Applicant: Panasonic Intellectual Property Management Co., Ltd., Osaka (JP)

(72) Inventor: Taichi Hamabe, Osaka (JP)

(73) Assignee: Panasonic Intellectual Property Management Co. Ltd., Osaka (JP)

( * ) Notice: Subject to any disclaimer, the term of this patent is extended or adjusted under 35 U.S.C. 154(b) by 0 days.

(21) Appl. No.: 15/897,223

(22) Filed: Feb. 15, 2018

(65) Prior Publication Data

US 2018/0183142 A1 Jun. 28, 2018

Related U.S. Application Data

(63) Continuation of application No. PCT/JP2016/003823, filed on Aug. 23, 2016.

(30) Foreign Application Priority Data

Aug. 31, 2015 (JP) ..... 2015-169942

(51) Int. Cl.
*H01Q 1/36* (2006.01)
*H01Q 9/30* (2006.01)
(Continued)

(52) U.S. Cl.
CPC ..... *H01Q 1/36* (2013.01); *H01Q 9/065* (2013.01); *H01Q 9/16* (2013.01); *H01Q 9/30* (2013.01); *H01Q 15/006* (2013.01); *H01Q 1/243* (2013.01); *H01Q 1/48* (2013.01); *H01Q 9/0407* (2013.01); *H01Q 15/0086* (2013.01)

(58) Field of Classification Search
CPC .... H01Q 9/065; H01Q 9/0407; H01Q 15/004; H01Q 15/006; H01Q 15/008; H01Q 15/0086
See application file for complete search history.

(56) References Cited

U.S. PATENT DOCUMENTS 7,042,419 B2 * 5/2006 Werner ..... H01Q 9/16 343/909
7,405,698 B2 * 7/2008 de Rochemont ..... H01Q 1/362 343/700 MS (Continued)

FOREIGN PATENT DOCUMENTS

JP 2015-070542 4/2015

OTHER PUBLICATIONS

International Search Report of PCT application No. PCT/JP2016/003823 dated Sep. 20, 2016.

*Primary Examiner* — Ricardo I Magallanes
(74) *Attorney, Agent, or Firm* — Wenderoth, Lind & Ponack, L.L.P.

(57) ABSTRACT

An antenna device is designed to be connected to a printed-circuit board having a feeding part and a board ground. The antenna device includes a feed antenna, an antenna ground having a plate shape, an artificial magnetic conductor having a plate shape and being formed between the feed antenna and the antenna ground, a first connection connecting the feed antenna with the feeding part by passing through the antenna ground and the artificial magnetic conductor, and a second connection connecting the antenna ground with the board ground. The artificial magnetic conductor is not connected to the first connection and the second connection.

12 Claims, 10 Drawing Sheets

(51) Int. Cl.

| | |
|---|---|
| ***H01Q 15/00*** | (2006.01) |
| ***H01Q 9/06*** | (2006.01) |
| ***H01Q 9/16*** | (2006.01) |
| ***H01Q 9/04*** | (2006.01) |
| ***H01Q 1/24*** | (2006.01) |
| ***H01Q 1/48*** | (2006.01) |

(56) References Cited

U.S. PATENT DOCUMENTS

| | | | | |
|---|---|---|---|---|
| 7,760,154 | B2 * | 7/2010 | Sekine | H01Q 1/38 343/795 |
| 2003/0197658 | A1 * | 10/2003 | Lilly | H01Q 1/243 343/909 |
| 2015/0263426 | A1 * | 9/2015 | Hsu | H01Q 5/378 343/787 |
| 2016/0020648 | A1 * | 1/2016 | Contopanagos | H01Q 19/185 307/104 |

* cited by examiner

ANTENNA DEVICE

TECHNICAL FIELD

The present disclosure relates to an antenna device.

SUMMARY OF THE INVENTION

An antenna device according to the present disclosure is designed to be connected to a printed-circuit board having a feeding part and a board ground. The antenna device includes a feed antenna, an antenna ground having a plate shape, an artificial magnetic conductor having a plate shape and being formed between the feed antenna and the antenna ground, a first connection connecting the feed antenna with the feeding part by passing through the antenna ground and the artificial magnetic conductor, and a second connection connecting the antenna ground with the board ground. The artificial magnetic conductor is not connected to the first connection and the second connection.

The antenna device according to the present disclosure can be readily mounted on an electronic device.

DESCRIPTION OF EMBODIMENTS

Hereinafter, exemplary embodiments will be described in detail with reference to the drawings as appropriate. However, more detailed description than necessary will be omitted in some cases. For example, the detailed description of well known matters and repeated description of substantially the same configuration may be omitted. This is to avoid the following description from being unnecessarily redundant, and to facilitate understanding of those skilled in the art.

Note that the attached drawings and the following description are provided for those skilled in the art to fully understand the present disclosure, and are not intended to limit the subject matter as described in the appended claims.

First Exemplary Embodiment

A first exemplary embodiment will now be described with reference to FIGS. 1 to 4.

An antenna device according to the first exemplary embodiment is an antenna for use in 2.4 GHz band applications such as Bluetooth (registered trademark) and Wireless Fidelity (Wi-Fi) networks. The antenna device can be applied to various electronic devices.

Figure 1:
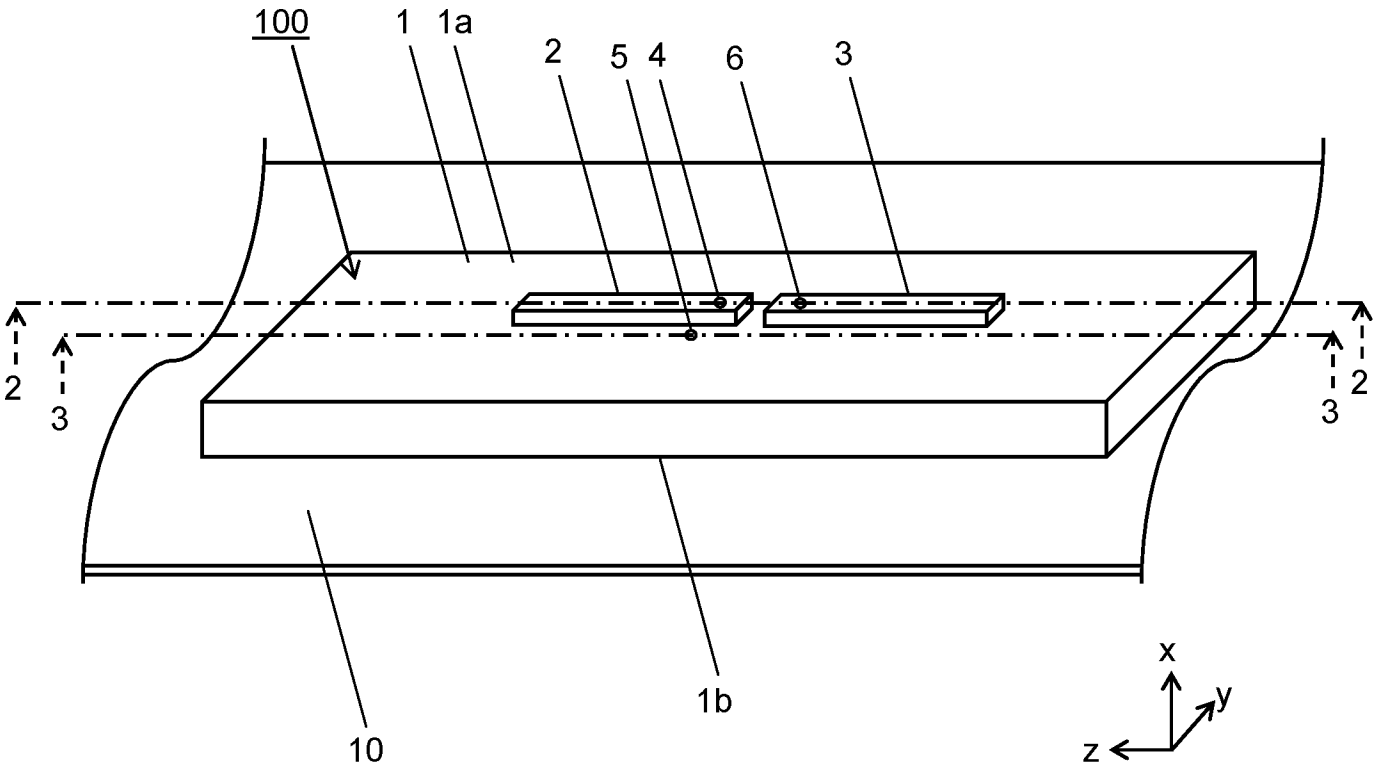
FIG. 1 is an external view of an antenna device according to a first exemplary embodiment.

FIG. 1 is an external view of the antenna device according to the first exemplary embodiment. In FIG. 1, the antenna device is mounted on printed-circuit board 10.

In the following description, antenna device 100 is a dipole antenna, for example. The dipole antenna is made from a multilayer substrate having a plurality of layers. The dipole antenna has a pattern that is formed on a surface of the dipole antenna by etching or other technique applied to metallic foil of the surface. The layers are each made of copper foil, glass epoxy or other material.

With reference to FIG. 1, antenna device 100 includes substrate 1, conductor 2 as an example feed antenna, conductor 3 as an example parasitic antenna, via 4 as an example first connection, via 5 as an example second connection, and via 6 as an example third connection.

Conductor (feed antenna) 2 and conductor (parasitic antenna) 3 are disposed on front side 1*a* of substrate 1 and have the same (identical) shapes, as show in FIGS. 1-4. Vias 4 to 6 (first, second, third connections) form a plurality of through holes running from front side 1*a* to back side 1*b* of substrate 1. Conductor 2 is connected with a feedpoint on printed-circuit board 10 by via 4 so as to function as a feed antenna. Conductor 3 is connected with a ground on printed-circuit board 10 by via 6 so as to function as a parasitic antenna.

In the description herein, a z-axis is equivalent to a longitudinal direction of antenna device 100. A y-axis is equivalent to a transverse direction of antenna device 100 and perpendicular to the z-axis. An x-axis is equivalent to a thickness direction of antenna device 100 and perpendicular to an yz-plane. Via 4 and via 6 are disposed at substantially middle positions in the y-axis direction of substrate 1 and are symmetric with respect to a center of substrate 1 along the z-axis. Via 5 need only be disposed at a position where via 5 is not in contact with conductors 2 and 3, and may be disposed near via 4, for example.

Figure 2:
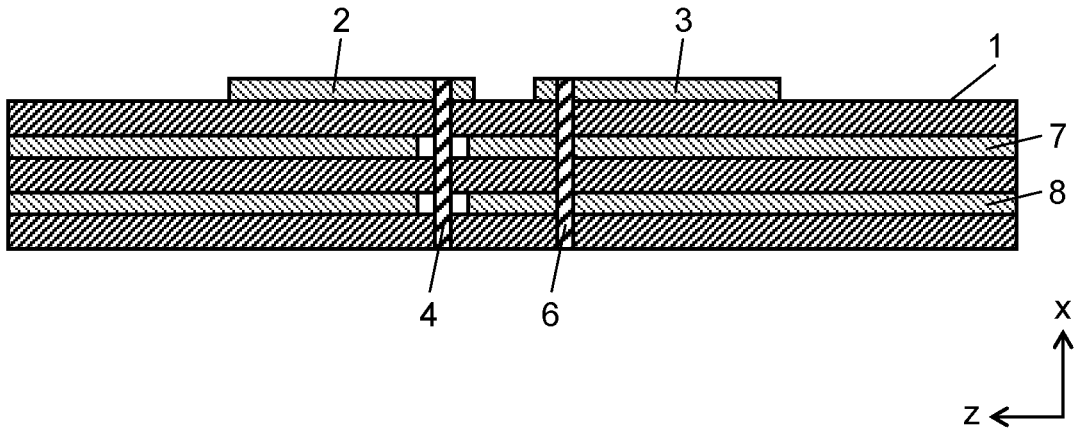
FIG. 2 is a cross-sectional view taken along line 2-2 of FIG. 1.

Vias 4 and 6 will now be described in detail. FIG. 2 is a cross-sectional view taken along line 2-2 of FIG. 1.

FIG. 2 is a cross-sectional view taken along a line that passes through vias 4 and 6 in FIG. 1.

With reference to FIG. 2, substrate 1, i.e. a multilayer substrate, includes artificial magnetic conductor (AMC) 7 and antenna ground 8. A dielectric made from glass epoxy or other material is put between AMC 7 and antenna ground 8. AMC 7 is an artificial magnetic conductor that possesses perfect magnetic conductor (PMC) properties and forms a predetermined metallic pattern. Use of AMC 7 enables the antenna device to achieve a reduction in thickness and an increase in gain. The gain herein represents a ratio of electric power received by antenna device 100 of this exemplary embodiment in a direction of the antenna's lobe having the greatest field strength to electric power received by a reference antenna device in the same direction when identical electric power is applied to these antenna devices. The increase in gain means a rise in the ratio of electric power received by antenna device 100 of this exemplary embodiment in the direction of the antenna's lobe having the greatest field strength to electric power received by the reference antenna device in the same direction when identical electric power is applied to these antenna devices. In other words, the increase in gain enables the antenna device to send out radio waves over an increased distance, for example.

Via 4 serves to supply electric power for driving conductor 2 as an antenna and is used to electrically connect conductor 2 on front side 1*a* of substrate 1 with a feeding part in an electronic device. Via 4 (i.e., the first connection) is not electrically connected to either AMC 7 or antenna ground 8.

Meanwhile, via 6 (i.e., the third connection) serves to connect conductor 3 with a ground and is used to electrically connect conductor 3 on the front side 1*a* of substrate 1 with a ground in the electronic device. Unlike via 4, via 6 is electrically connected to both AMC 7 and the antenna ground 8.

A relationship between a thickness of antenna device 100 and a frequency band will be described below.

The antenna device must be kept tuned to a certain frequency bandwidth to serve as an antenna for use in 2.4 GHz band applications such as Bluetooth (registered trademark) and Wi-Fi networks, for example. Generally, the frequency bandwidth that the antenna device is compatible with narrows with a reduction in thickness of AMC 7 and antenna ground 8. Thus, these layers are recommended to be as thick as possible in terms of antenna characteristics. On the other hand, an increase in the thickness of AMC 7 and antenna ground 8 causes antenna device 100 to get larger. To achieve a balance between keeping antenna device 100 tuned to the frequency bandwidth and downsizing antenna device 100, both AMC 7 and antenna ground 8 need to be connected with a ground. Specifically, if antenna device 100 works in the 2.4 GHz band at a transmission rate of 100 Mbps, for example, the thickness of antenna device 100 needs to be larger than 5 mm unless both AMC 7 and antenna ground 8 are connected with a ground. However, if both AMC 7 and antenna ground 8 are connected with the ground, the thickness of AMC 7 and antenna ground 8 can come down to a range between 1 mm and 2 mm and the thickness of antenna device 100 can thus come down to 5 mm or smaller. For this reason, in this exemplary embodiment as described above, via 6 is electrically connected to AMC 7 and antenna ground 8.

Antenna device 100 is disposed on printed-circuit board 10 of the electronic device and is connected to the feedpoint and the ground on printed-circuit board 10 of the electronic device by way of back side 1*b* of substrate 1 to serve a purpose of the electronic device. Since the existence of a metal or any influence in proximity to antenna device 100 may cause a deviation in frequency and a reduction in communication performance, it is preferable that antenna device 100 be connected to printed-circuit board 10 by way of back side 1*b*.

Figure 3:
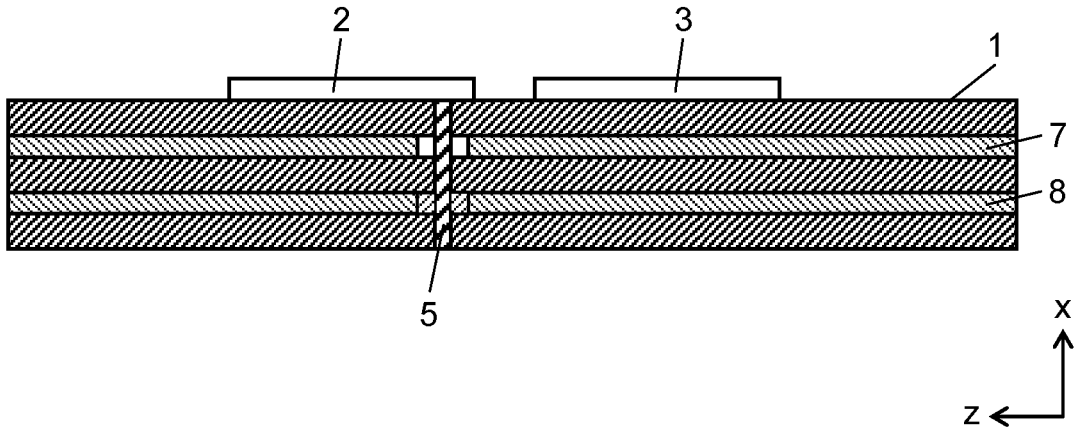
FIG. 3 is a cross-sectional view taken along line 3-3 of FIG. 1.

Via 5 (i.e., the second connection) will now be described in detail. FIG. 3 is a cross-sectional view taken along line 3-3 of FIG. 1. FIG. 3 is a cross-sectional view taken along a line that passes through via 5.

With reference to FIG. 3, via 5 (the second connection) functions as a ground for conductor 2 and is formed in parallel with via 4 along the x-axis. Antenna ground 8 is electrically connected with the ground on printed-circuit board 10 by way of via 5.

Figure 4:
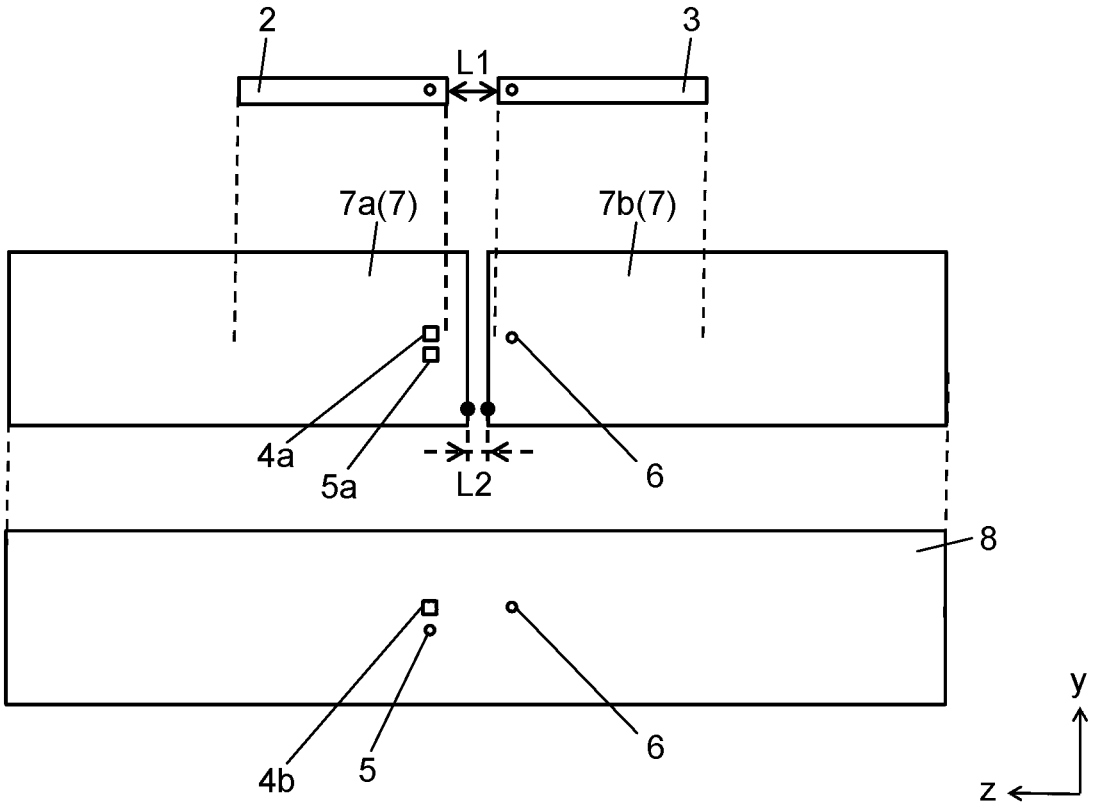
FIG. 4 is a conceptual diagram illustrating the antenna device according to the first exemplary embodiment.

With reference to FIG. 4, the shapes of conductor 2, conductor 3, AMC 7, and antenna ground 8 that are each an antenna will now be described. FIG. 4 is a conceptual diagram illustrating the antenna device according to the first exemplary embodiment.

With reference to FIG. 4, AMC 7 has a slit that is provided at a middle of AMC 7 in the z-axis direction. Thus, AMC 7 is formed of two metallic patterns of AMC 7*a* and AMC 7*b* such that a shape of the two metallic patterns of AMC 7*a* and AMC 7*b* is identical, as shown in FIG. 4.

AMC 7*a* includes hollows provided at positions that via 4 and via 5 pass through, respectively. These hollows respectively constitute holes 4*a*, 5*a* that have larger vertical cross sections (yz-cross sections) than the vertical cross sections of via 4 and via 5. Vias 4 and 5 are inserted through the hollows such that AMC 7*a* is not connected to vias 4 and 5. The yz-cross sections of holes 4*a*, 5*a* are each shaped into a square. Each side of the square has a length that is longer than respective diameters of vias 4 and 5.

In common with AMC 7*a*, antenna ground 8 includes a hollow provided at a position that via 4 passes through. The hollow constitutes hole 4*b* that has a larger vertical cross section (a yz-cross section) than the vertical cross section of via 4. Via 4 is inserted through the hollow such that antenna ground 8 is not connected to via 4. The yz-cross section of hole 4*b* is shaped into a square. Each side of the square has a length that is longer than every diameter of via 4.

In FIG. 4, the cross sections of holes 4*a*, 4*b*, 5*a* are each shaped into a square. However, holes 4*a*, 4*b*, 5*a* may be each a triangle or a circular polygon in cross sectional shape and may be configured in any size with proviso that inner surfaces of holes 4*a*, 4*b*, 5*a* do not come into contact with vias 4 and 5. The hollows may constitute cutouts or slits, for example, other than the holes.

Gap L1 between conductors 2 and 3 is wider than gap L2 between AMCs 7*a* and 7*b*. This is because a function of AMC 7 is put to full use only if conductors 2 and 3 are disposed over AMCs 7*a* and 7*b* such that gap L1 covers the whole of gap L2.

Second Exemplary Embodiment

Figure 5:
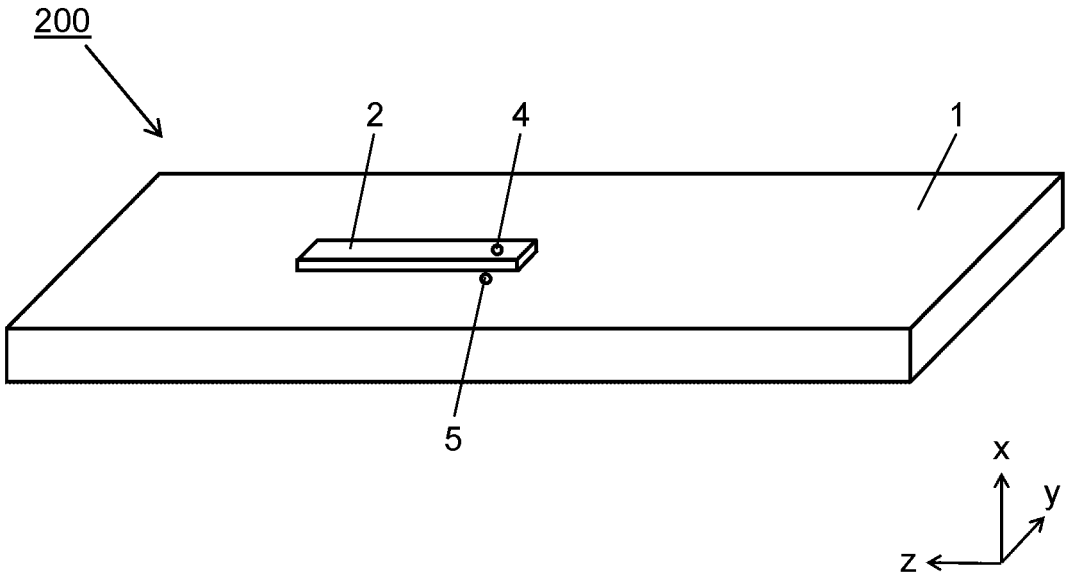
FIG. 5 is an external view of an antenna device according to a second exemplary embodiment.

With reference to FIG. 5, an antenna device according to a second exemplary embodiment will now be described. The antenna device is a monopole antenna. FIG. 5 is an external view of the antenna device according to the second exemplary embodiment.

With reference to FIG. 5, antenna device 200 includes substrate 1, conductor 2 as an example feed antenna, via 4 as an example first connection, and via 5 as an example second connection. A configuration of the monopole antenna is equivalent to that of the dipole antenna except that the monopole antenna is without conductor 3 and via 6. Thus, detailed description on the configuration of the monopole antenna is omitted.

Figure 6A:
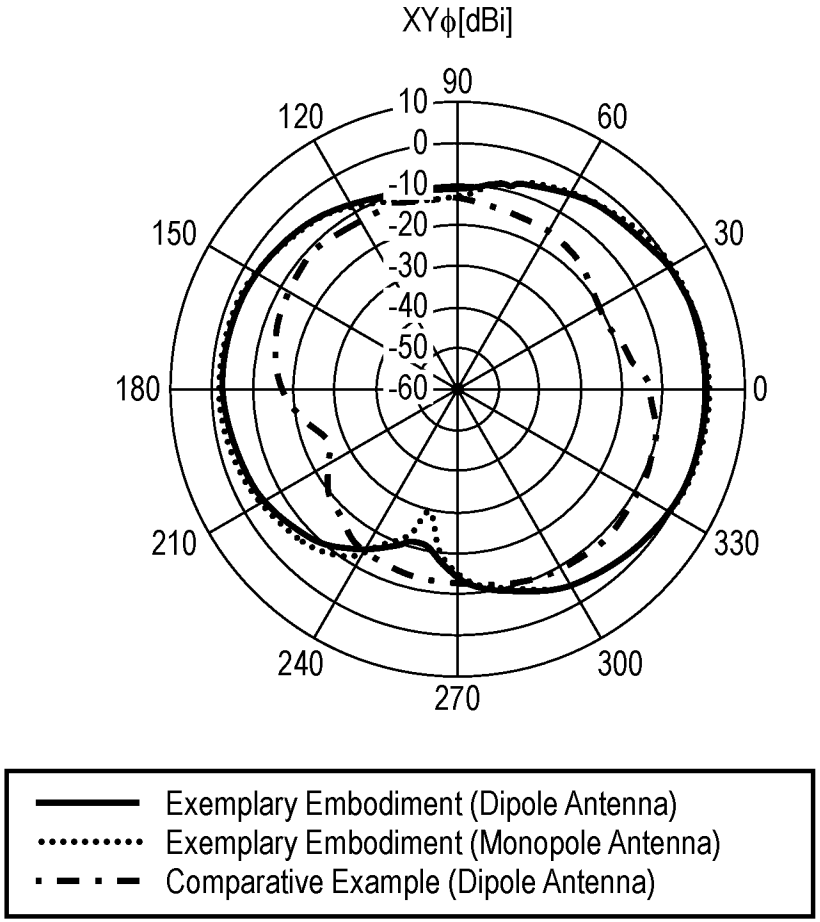
FIG. 6A is a diagram illustrating radiation patterns of antenna devices, represented on an xy-plane.
Figure 6B:
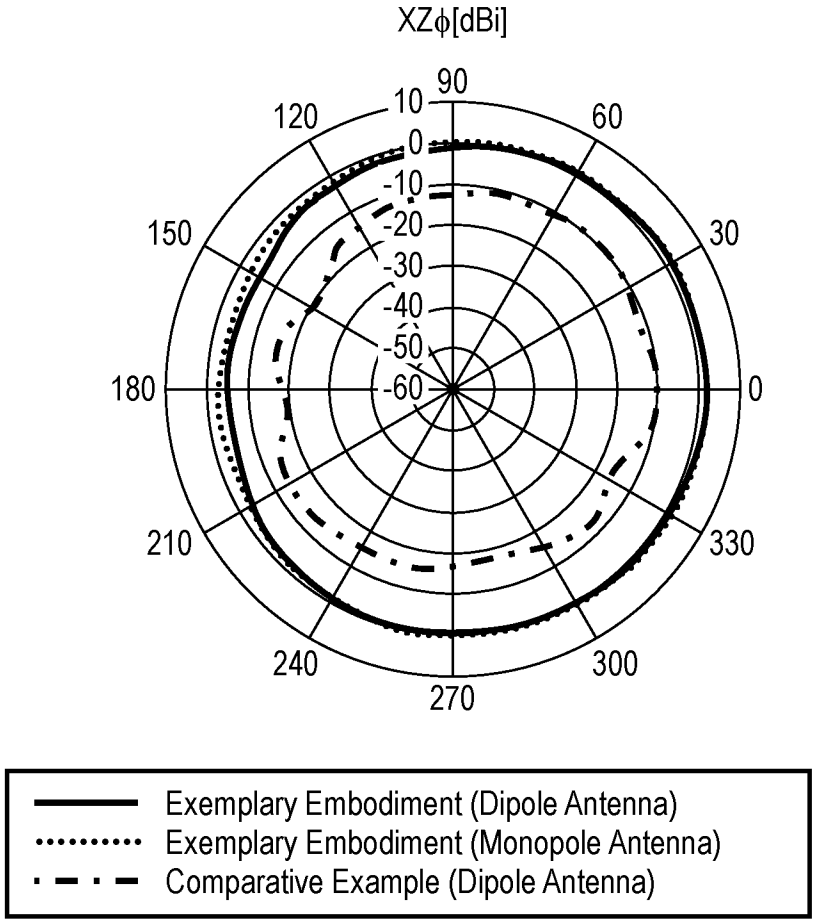
FIG. 6B is a diagram illustrating radiation patterns of the antenna devices, represented on an xz-plane.
Figure 7:
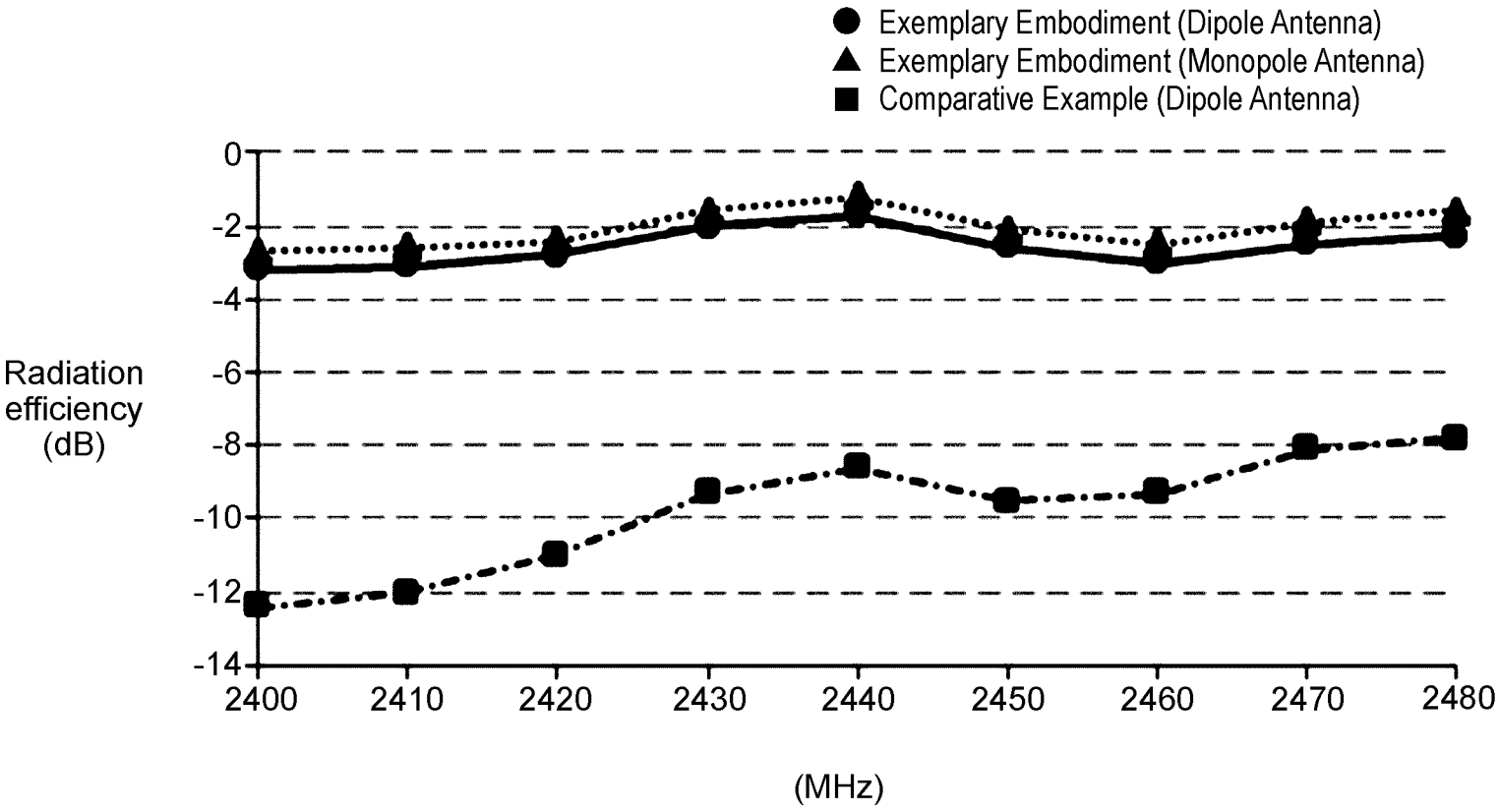
FIG. 7 is a graph illustrating radiation efficiencies of the antenna devices.
Figure 8A:
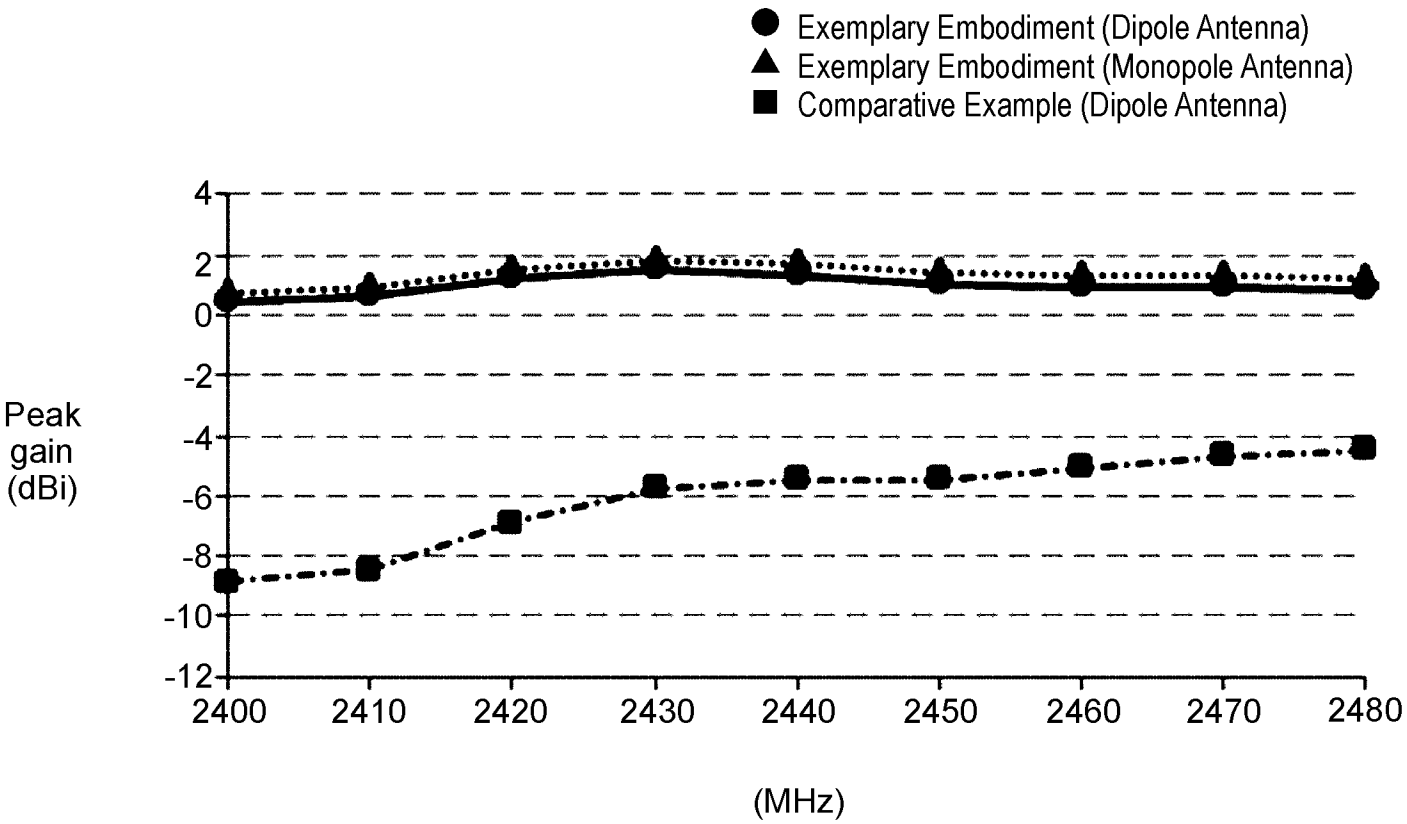
FIG. 8A is a graph illustrating peak gains of the antenna devices, represented on an xy-plane.
Figure 8B:
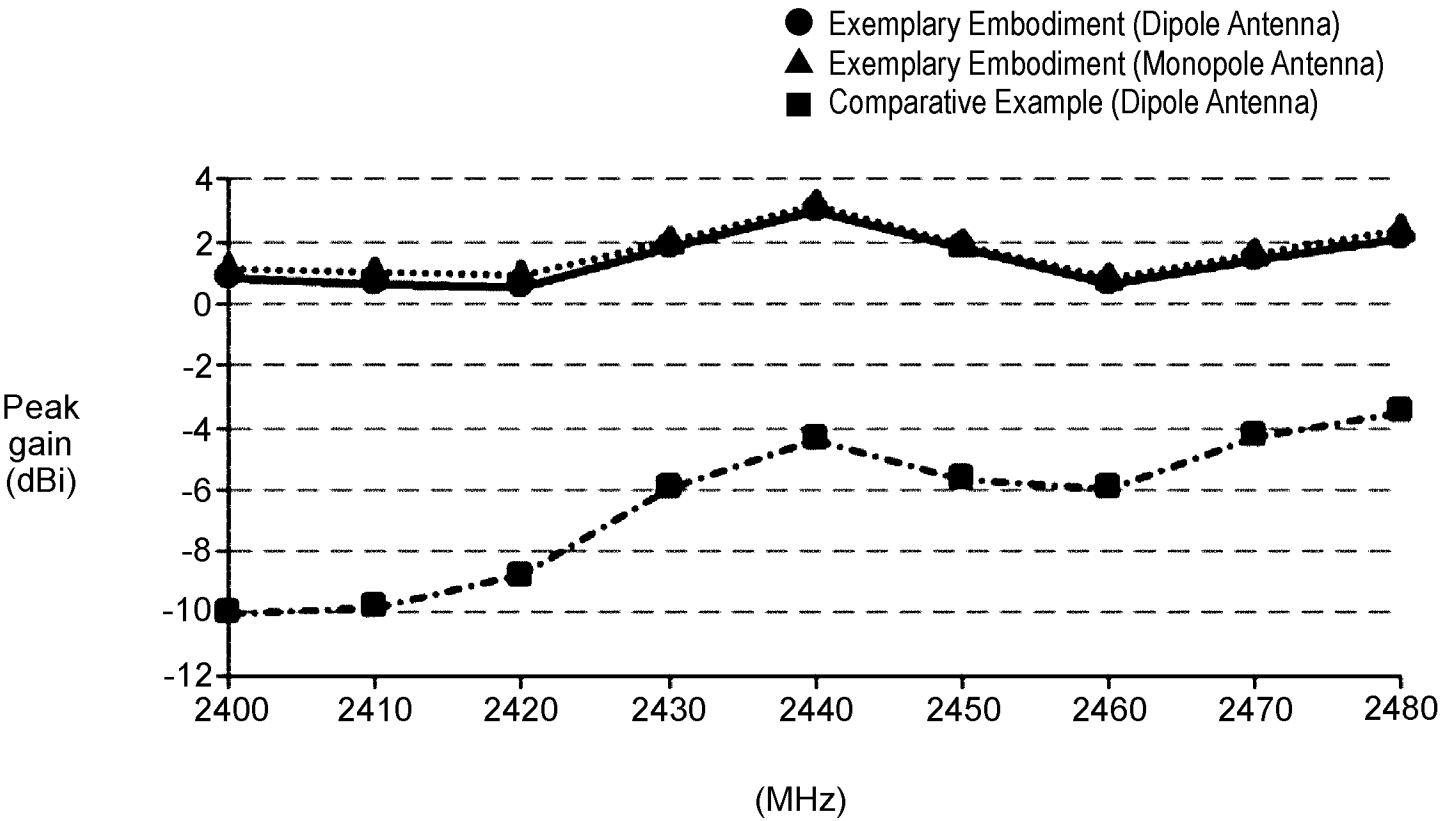
FIG. 8B is a graph illustrating peak gains of the antenna devices, represented on an xz-plane.
Figure 9A:
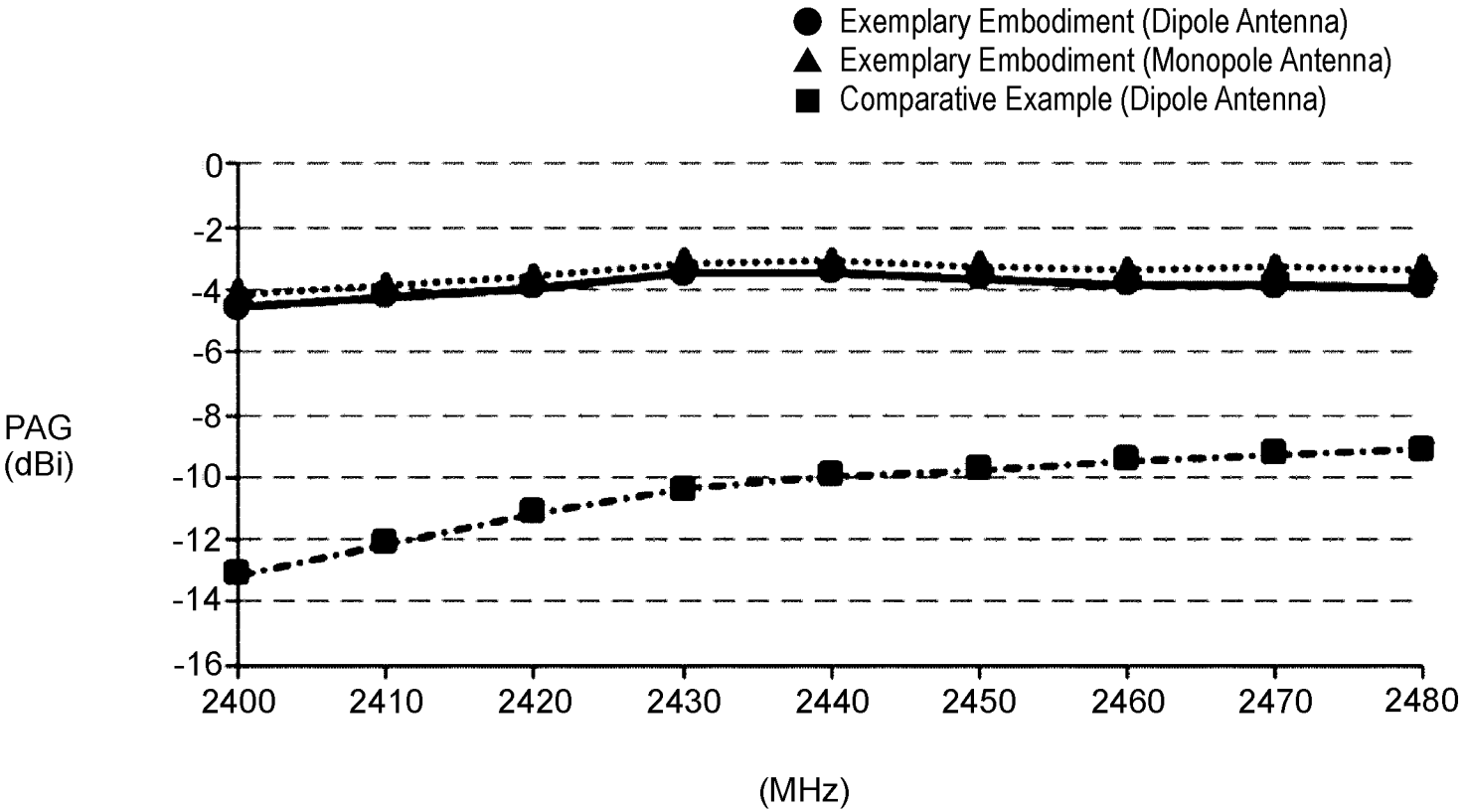
FIG. 9A is a graph illustrating pattern average gains of the antenna devices, represented on an xy-plane.
Figure 9B:
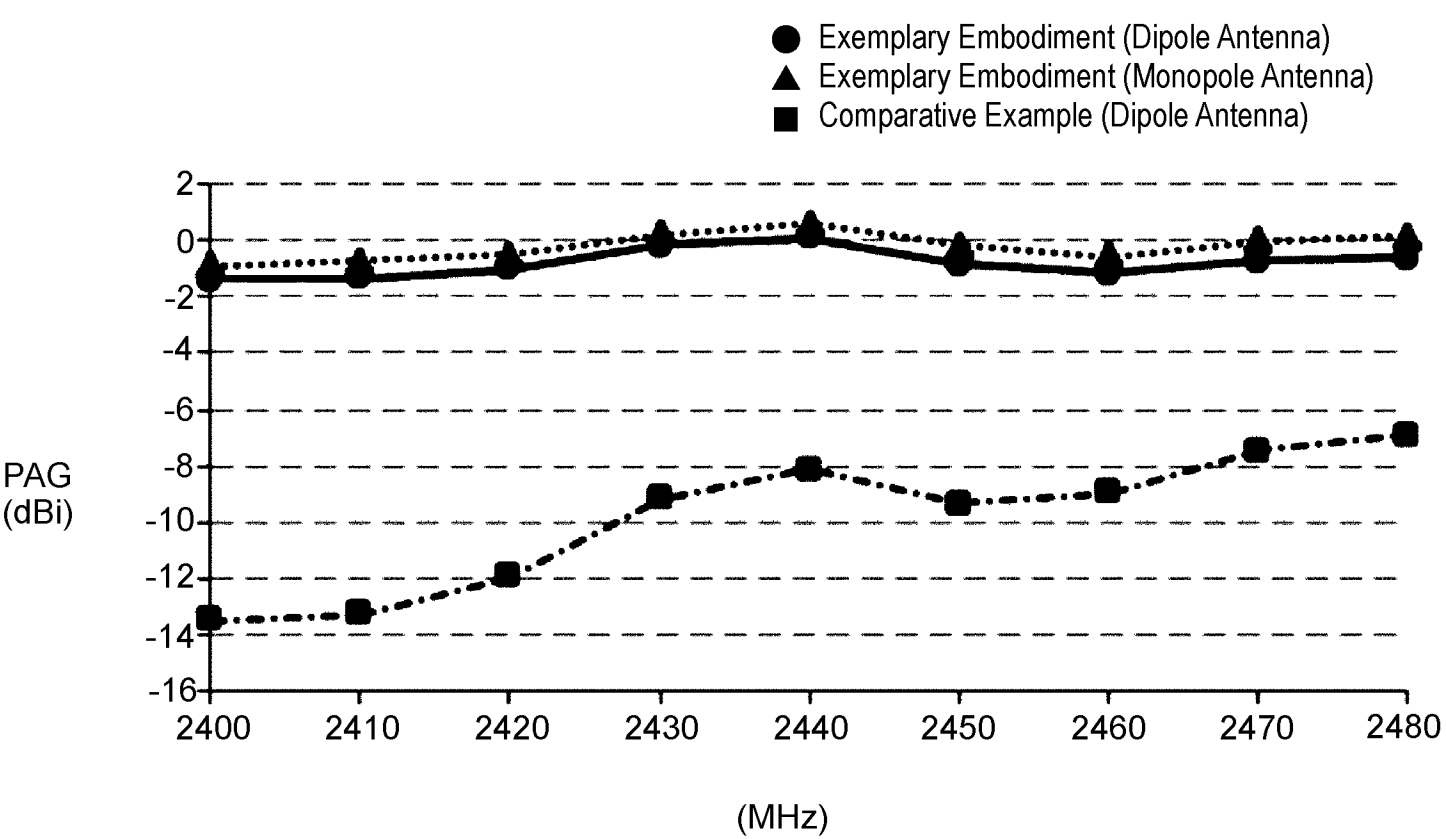
FIG. 9B is a graph illustrating pattern average gains of the antenna devices, represented on an xz-plane.

With reference to FIGS. 6A to 9B, a description will be given of capabilities of the dipole antenna and the monopole antenna having the configurations described above. FIGS. 6A and 6B are each a diagram illustrating radiation patterns of the antenna devices. FIG. 7 is a graph illustrating radiation efficiencies of the antenna devices. FIGS. 8A and 8B are each a graph illustrating peak gains of the antenna devices. FIGS. 9A and 9B are each a graph illustrating pattern average gains of the antenna devices. A set of xyz-coordinate axes in the description given hereafter is identical to the coordinate axes used in FIGS. 1 and 2. FIGS. 6A and 6B each illustrate a relationship between angles and absolute gains with respect to the z-axis. In FIGS. 7 to 9B, the horizontal axis represents frequency, and the vertical axis represents radiation efficiency (FIG. 7), peak gain (FIGS. 8A and 8B), and pattern average gain that is abbreviated to PAG (FIGS. 9A and 9B).

In this exemplary embodiment, the absolute gain represents a gain obtained with a hypothetical antenna set to a reference antenna device. The PAG is an average gain determined from data on gains obtained in all measured directions.

The PAG in FIGS. 9A and 9B is an average value determined from absolute gains in an angular range of positive and negative 30 degrees from 0 degree (0 degree to 30 degrees and 330 degrees to 0 degree) in either of FIGS. 6A and 6B.

FIG. 6A illustrates radiation patterns represented on the xy-plane. FIG. 6B illustrates the radiation patterns represented on the xz-plane. The solid lines show the pattern for the dipole antenna described above. The dot lines show the pattern for the monopole antenna described above. The dash-dot lines show the pattern for a dipole antenna prepared as a comparative example. These radiation patterns were taken at a frequency of 2,450 MHz.

The dipole antenna of the comparative example differed from the dipole antenna of this exemplary embodiment in terms of connection made by via 6. Specifically, via 6 in the comparative example was not connected to AMC 7 and antenna ground 8 but was connected only to a ground on a substrate of an electrical apparatus.

FIGS. 6A and 6B show that the antennas of this exemplary embodiment provided higher absolute gains than the antenna of the comparative example in almost all directions.

From the viewpoint of overall antenna radiation efficiency, as illustrated in FIG. 7, a comparison among the antennas over a frequency range in 10 MHz steps showed that the antennas of this exemplary embodiment provided higher efficiency than the antenna of the comparative example and offered up to around 10 dB higher efficiency than the comparative example.

As illustrated in FIGS. 8A and 8B, a comparison in peak gain showed that the antennas of this exemplary embodiment were highly efficient.

As illustrated in FIGS. 9A and 9B, a comparison among the antennas in terms of the PAGs represented on the xy- and xz-planes showed that the antennas of this exemplary embodiment were highly efficient.

As described above, antenna device 100 according to this exemplary embodiment can come down in thickness while ensuring a predetermined capability. In addition, antenna device 100 can be readily mounted on an electronic device or other apparatus because antenna device 100 can be connected to the feeding part and the ground on printed-circuit board 10 by way of back side 1*b*.

Other Exemplary Embodiments

In the exemplary embodiments described above, the dipole antenna and the monopole antenna are taken as examples to illustrate technique disclosed in this patent application. However, the technique may be illustrated using any of other antennas such as inverted-L antennas and inverted-F antennas.

In the exemplary embodiments described above, the antennas are for use in the 2.4 GHz band. The antennas may be designed to operate at other frequencies.

In the exemplary embodiments described above, the antenna devices are each made from a multilayer substrate. However, the antenna device may have any other configuration with proviso that the antenna, AMC 7, and antenna ground 8 are stacked in order. For example, an air layer may be put between conductors 2 and 3, and AMC 7.

The above exemplary embodiments are an illustration of the technique of the present disclosure. Therefore, various changes, replacements, additions, or omissions may be made to the exemplary embodiments within the scope of claims or their equivalents.

INDUSTRIAL APPLICABILITY

An antenna according to the present disclosure can be readily mounted on an electronic device. Thus, the antenna for use in wireless equipment can be applied to various apparatuses such as personal computers (PCs), portable devices, and traveling objects (e.g. vehicles, buses, and airplanes).

REFERENCE MARKS IN THE DRAWINGS

1 substrate
1*a* front side
1*b* back side
2 conductor (feed antenna)
3 conductor (parasitic antenna)
4, 5, 6 via (first to third connections)
7 AMC
8 antenna ground
10 printed-circuit board

The invention claimed is:

1. An antenna device comprising:
a substrate having a surface;
a feed antenna on the surface;
a parasitic antenna on the surface;
an antenna ground having a plate shape;
a first artificial magnetic conductor having a plate shape and being formed between the feed antenna and the antenna ground;
a second artificial magnetic conductor having a plate shape and being formed between the parasitic antenna and the antenna ground;
a first connection connected to the feed antenna and passing through the antenna ground and the first artificial magnetic conductor; and
a second connection connected to the parasitic antenna and passing through the antenna ground and the second artificial magnetic conductor,
wherein the first connection is not connected to either the first artificial magnetic conductor or the antenna ground,
wherein the second connection is connected to both the second artificial magnetic conductor and the antenna ground, and
wherein a shape of the feed antenna is identical to a shape of the parasitic antenna.

2. The antenna device according to claim 1, wherein the first connection is not electrically connected to either the first artificial magnetic conductor or the antenna ground.

3. The antenna device according to claim 2, wherein the first connection is not directly electrically connected to either the first artificial magnetic conductor or the antenna ground.

4. The antenna device according to claim 1, wherein a distance between the first connection and the second connection is less than a length of the feed antenna.

5. The antenna device according to claim 1, wherein the first connection is connected to the feed antenna at a side of the feed antenna closest to the parasitic antenna.

6. The antenna device according to claim 1, wherein the second connection is connected to the parasitic antenna at a side of the parasitic antenna closest to the feed antenna.

7. The antenna device according to claim 1, wherein:

the first connection is connected to the feed antenna at a side of the feed antenna closest to the parasitic antenna, and the second connection is connected to the parasitic antenna at a side of the parasitic antenna closest to the feed antenna.

8. The antenna device according to claim 1, wherein a shape of the first artificial magnetic conductor is identical to a shape of the second artificial magnetic conductor.

9. The antenna device according to claim 8, wherein a distance between the first connection and the second connection is less than a length of the first artificial magnetic conductor.

10. The antenna device according to claim 1, wherein the first artificial magnetic conductor is adjacent to the second artificial magnetic conductor with no intervening magnetic conductor between the first artificial magnetic conductor and the second artificial magnetic conductor.

11. The antenna device according to claim 1, further comprising a third connection connected to the antenna ground and passing through the first artificial magnetic conductor, wherein the third connection is not connected to the first artificial magnetic conductor.

12. The antenna device according to claim 11, wherein the first connection, the second connection, and the third connection are configured such that a virtual line connecting the first connection with the second connection is perpendicular to a virtual line connecting the first connection with the third connection.

* * * * *